United States Patent [19]

Izui et al.

[11] Patent Number: 4,992,625

[45] Date of Patent: Feb. 12, 1991

[54] RIBBON CABLE WITH SHEATH

[75] Inventors: Isao Izui; Tetsuo Imamura; Junichi Mori, all of Kanagawa, Japan

[73] Assignee: Oki Densen Kabushiki Kaisha, Kawasaki, Japan

[21] Appl. No.: 301,618

[22] Filed: Jan. 25, 1989

[30] Foreign Application Priority Data

Jan. 27, 1988 [JP] Japan ..... 63-8957

[51] Int. Cl.[5] ..... H01B 7/34; H01B 7/08

[52] U.S. Cl. ..... 174/36; 174/32; 174/117 F

[58] Field of Search ..... 174/32, 36, 117 R, 117 F, 174/117 FF

[56] References Cited

U.S. PATENT DOCUMENTS

| | | | |
|---|---|---|---|
| 243,180 | 6/1881 | Ware | 174/117 F |
| 3,609,216 | 9/1971 | Copp | 174/117 FF X |
| 3,836,415 | 9/1974 | Hilderbrandt | 174/117 F X |
| 4,381,208 | 4/1983 | Baverstock | 174/117 F X |
| 4,767,891 | 8/1988 | Biegon et al. | 174/117 F X |
| 4,837,405 | 6/1989 | Bonjour et al. | 174/36 |

FOREIGN PATENT DOCUMENTS

| | | | |
|---|---|---|---|
| 20578 | 2/1978 | Japan | 174/117 F |
| 2176926 | 1/1987 | United Kingdom | 174/117 F |

*Primary Examiner*—Morris H. Nimmo

*Attorney, Agent, or Firm*—Bachman & LaPointe

[57] ABSTRACT

A multi conductor cable with a sheath having improved mechanical flexibility is provided. The cable comprises a ribbon cable in which a plurality of core wires are connected parallel in same sections to each other and in other section, the plurality of the wires are separate. These sections are arranged alternately in the longitudinal direction of the ribbon cable. The transversely central portion of the ribbon cable is curved into about S-shape, which offers superior elastic properties. Side portions of the ribbon are wound around the central S-shaped portion to form the core of the cable according to the invention.

7 Claims, 3 Drawing Sheets

RIBBON CABLE WITH SHEATH

BACKGROUND OF THE INVENTION

The present invention relates generally to a cable with a sheath having improved mechanical flexibility and for better facilitating a connector terminal. More specifically, the invention relates to a cable having a cylindrical sheath wherein a ribbon cable including a plurality of discrete core wires is folded.

Sheathed multiconductor cables comprising a plurality of discrete core wires are generally useful for making connections between electronic communication devices or so forth. The core of such cables is generally formed by forming a ribbon comprised of a plurality of core wires, each of which is covered by an insulating material arranged parallel to each other and which are connected by bonding or fusing the insulating material. This ribbon is folded in the longitudinal direction and covered by a cylindrical sheath. Such cables have good mechanical flexibility and terminal treatment is easy.

Japanese Utility Model First Publication (jikkaisho) No. 53-59671 exemplifies one such conventional cable with a sheath. In the cable, conductor ribbon cable is folded into a spiral and wrapped with the sheath. The cable has good mechanical flexibility. However, when terminal treatment is carried out, that is, the end sheath of the cable is stripped so as to expose the flat cable and the exposed cable is extended to be connected to a line connector, a long exposed length of the ribbon is necessary.

Further, Japanese Patent First Publication (tokkaisho) No. 59671 exemplifies a conventional covered cable having a ribbon cable which is adapted for facilitating terminal treatment with a shorter exposed length of the ribbon cable. The ribbon cable is folded so as to form pleats and is covered with a sheath. The pleated ribbon type cable however has the disadvantage that the top portions of the pleats tend to be creased which stretches or distorts the insulation, thus decreasing pitch accuracy between core wires of the ribbon cable. This results in increased difficulty in connecting the conductors of the ribbon cable to the pins of the line connector. Moreover, bending in the lateral direction of the pleats becomes difficult, reducing the flexibility of the cable in lateral directions.

SUMMARY OF THE INVENTION

It is, accordingly, an object of the present invention to provide a cable with a sheath comprising a ribbon cable for facilitating terminal treatment and having improved mechanical flexibility.

According to one aspect of the present invention, there is provided a cable which comprises a ribbon cable folded so as to define a S-shape cross section in the core of the cable, the ribbon cable being comprised of a plurality of discrete conductors each of which is covered by an insulating member, the insulating members being bonded to each other and a sheath for covering the ribbon cable.

According to an another aspect of the invention, there is provided a cable which comprises a ribbon cable folded so as to define a S-shape cross section in the core of the cable, ribbon cable being comprised of a plurality of discrete conductors each of which is covered by an insulating member, the ribbon cable being provided with bonded and non-bonded sections which are alternately arranged over the length of said ribbon cable, the insulating members being mutually bonded so as to define a ribbon in the bonded sections and the insulating members being mutually separated in the non-bonded sections, both side portions of the ribbon cable being arranged around the central S-shaped portion so as to be diametrically opposed about the center of the cable and a sheath for covering the ribbon cable.

According to a further aspect of the invention, there is provided a cable which comprises a ribbon cable longitudinally folded so as to define a plurality of pleats in the core of the cable, the ribbon cable including longitudinally bonded cable sections and non-bonded cable sections arranged over the length of the ribbon cable, the bonded cable sections being comprised of a plurality of conductors each of which is covered by an insulating member and bonded with the other covered conductors so as to be spaced parallel to each other, and in said non-bonded cable sections the conductors being mutually separate, both side portions of the ribbon cable being arranged around the central pleated portion and a sheath for covering the ribbon cable.

BRIEF DESCRIPTION OF THE DRAWINGS

The present invention will be understood from the detailed description given hereinbelow and from the accompanying drawings of the preferred embodiments which are given for explanation and understanding only and are not intended to imply limitations to the invention.

DESCRIPTION OF THE PREFERRED EMBODIMENTS

Figure 1:
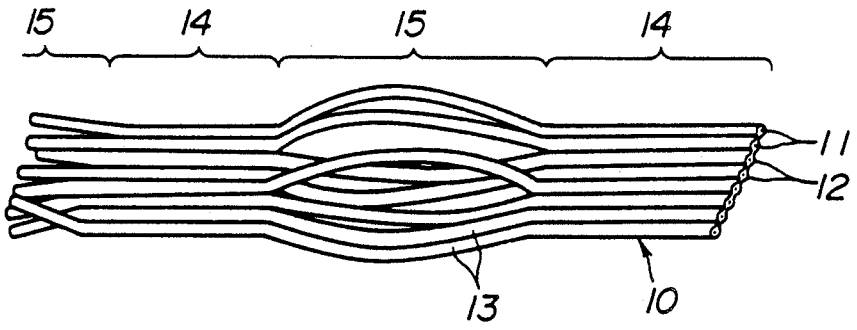
FIG. 1 is a perspective view which shows a flat cable.

Referring now to the drawings, particularly to FIG. 1, there is illustrated a ribbon cable 10. The cable 10 comprises a plurality of core wires 13. Each of the core wires 13 comprises a conductor 11 which is covered by a layer of insulating material 12. The core wires 13 are thermally welded to each other at longitudinal sections thereof so that the conductors 11 are spaced from each other by a predetermined distance on a plane, in bonded sections 14. Between the bonded sections are sections 15 where the core wires 13 are not bonded. In the non bonded sections 15, the core wires 13 may all be separate from each other, or some groups in which a few core wires are connected to each other may be provided. These sections 14 and 15 are arranged alternately over the length of the ribbon cable 10.

Figure 2:
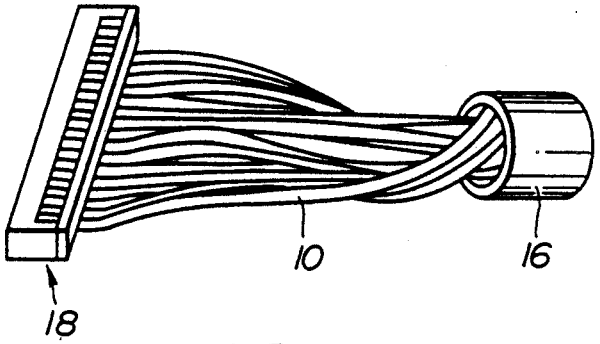
FIG. 2 is a perspective view which shows an exposed section of a ribbon cable comprised of a plurality of insulated core wires welded thermally to each other, connected to a multi-pin jack or line connector.

The separation of the core wires in the section 15 provides increased mechanical flexibility to the ribbon cable 10. The ribbon cable 10 is longitudinally folded and wrapped in a sheath to form a covered cable. The bonded section 14 provides easy collective termination of the conductors in a line connector such as that shown in FIG. 2.

Figure 3:
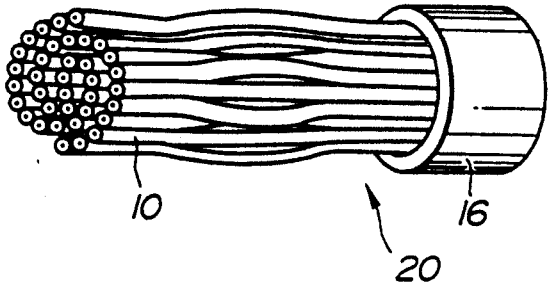
FIG. 3 is a perspective view which shows a first embodiment of a ribbon cable folded according to the invention and protruding from the sheath.

FIG. 3 shows a first embodiment according to the invention. A covered cable 20 comprises the ribbon cable 10 and a sheath 16 enclosing it. As described above, conventional cables exist in which a sheath encloses a longitudinally folded conductor ribbon. The cable 20 according to the invention however provides improved flexibilty and termination characteristics. The conductor ribbon cable 10 is folded longitudinally so as to take the form of S-shape at its central section and the side portions are wrapped around the central S-shaped portion. Side sections of the ribbon cable preferably surround the S-folded central portion so that the edges are arranged at diametrically opposite positions about the center thereof. The ribbon cable 10 curved into the above configuration is then encased by the sheath 16 to provide the compact cable 20.

Figure 4A:
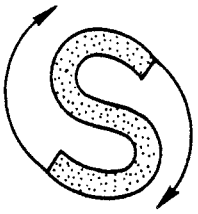
FIG. 4(*a*), 4(*a'*), 4(*b*), and 4(*b'*) are explanatory views which show folding configurations of ribbon cables, according to the invention.
Figure 4B:
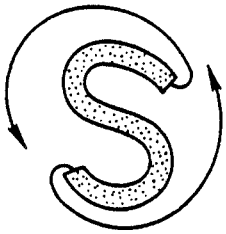

FIGS. 4(*a*), 4(*a'*), 4(*b*), and 4(*b'*) show various folding patterns for the ribbon cable 10 applicable in the cable according to the invention. FIG. 4(*a*) shows a clockwise wound S-shape curving configuration wherein the central portion of the ribbon cable is folded into the form of a S-shape and the peripheral portion thereof is wound around the central S-shaped portion in the clockwise direction. This curved configuration corresponds to that shown in FIG. 3. FIG. 4(*a'*) shows a counterclockwise reverse S-shaped curved configuration wherein the central portion of the ribbon cable is substantially in the form of reverse S-shape and the peripheral portion thereof is wound around the central reverse S-shaped portion in the counterclockwise direction. This curved configuration can however be viewed at the opposite side of the cross section showing curved configuration indicated in FIG. 4(*a*). It should be noted that the folds of the ribbon cable, shown in FIGS. 4(*a*) and 4(*a'*), are therefore identical to each other. FIG. 4(*b*) shows a configuration which is substantially equal to that shown in FIG. 4(*a*) with respect to the central cross sectional portion but differs in that the side portions are bent in the counterclockwise direction so as to surround the central S-shaped portion. FIG. 4(*b'*) shows a fold configuration which is the mirror image of that shown in FIG. 4(*b*). This configuration can however also viewed at the opposite side of the cross section showing curved configuration indicated in FIG. 4(*b*).

Figure 5:
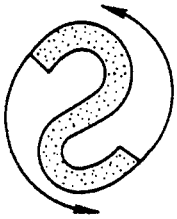
FIG. 5 is a perspective view which shows a second embodiment of a ribbon cable with a sheath having a shielding member.
Figure 5:
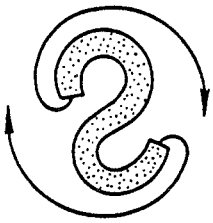
Figure 5:
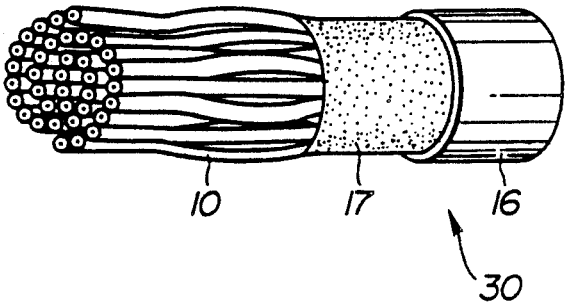

FIG. 5 shows a second embodiment of the cable according to the invention. A cable 30 comprises a ribbon cable 10 which can be folded into the various cross sectional shapes described above, a shielding member made of conductive material, and a sheath 16. The shielding member 17 encloses the folded ribbon cable 10 and is interposed within the sheath 16. It is appreciated that the shielding member 17 can effectively protect the conductors 11 of the cable 30 from electromagnetic interference.

Figure 6:
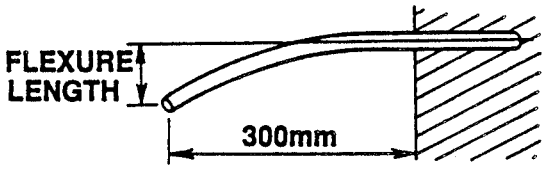
FIGS. 6–8 show a test method and measured parameters for cable tests, with the results set out in Tables 1–3 hereinbelow.

FIG. 6 and Table 1 below show the results of tests for measuring mechanical flexibility parameters of a cable according to the invention comprising 50 core wires and a conventional type cable which comprises a helically wound ribbon having 50 core wires. In these tests as shown in FIG. 6, deflection in sections of cable was determined due to bending under their own weight. A section of cable was arranged so as to project horizontally with a 300 mm end section thereof unsupported. The test results shows that deflection in the conventional cable was 60 mm, while deflection in the cable of the invention was 165 mm. In the cable having the above described folded ribbon core configuration according to the invention, distortion due to bending is absorbed by both the non bonded portion 15 and the central S-shaped portion of the ribbon cable 10, greatly improving the mechanical flexibility thereof as shown by the above test results. It will therefore be noted that the cable of the invention increases the reliability of the connection with a line connector or so forth and decreases the change of wire breakage.

TABLE 1

| THE RESULTS (50 CONDUCTORS) | |
|---|---|
| CONVENTIONAL SPIRAL TYPE CABLE | 60 mm |
| CABLE OF THE INVENTION | 165 mm |

Figure 7:
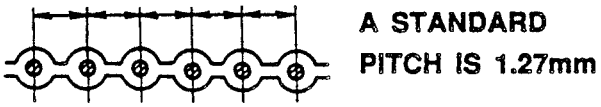
Figure 8:
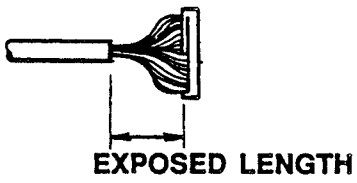

FIG. 7 and Table 2 below show the results of tests of the pitch accuracy between core wires. In these tests as shown in FIG. 7, the cables were provided which had a core comprised of cables wherein the insulators of core wires are thermally welded to each other with a standard pitch of 1.27 mm. After the cables was subjected by external forces, the pitch were measured in an extended ribbon cable 10. The test results showed that pitch variations in the conventional type cable in which the ribbon cable was folded into pleates was accurate to ±0.015 mm, while that of the cable according to the invention was accurate to ±0.003. Since the central S-shaped portion of the ribbon cable exhibits elastic properties which effectively absorb external forces from every direction, creasing of the cable can be prevented. Therefore, the pitches between the core wires can be kept to a high accuracy when the folded ribbon cable is extended in order to be connected to a line connector. This results in greatly improved reliability of the connection of the ribbon cable to the line connector and increases the ease with which the connection therebetween can be made.

TABLE 2

| THE RESULTS (50 CONDUCTORS) | |
|---|---|
| CONVENTIONAL PLEATS TYPE CABLE | 1.27 ± 0.015 mm |
| CABLE OF THE INVENTION | 1.27 ± 0.003 mm |

Table 3 shows the length of the portion of the ribbon cable required to be removed from the sheath in order to allow connection with a line connector. The measurements show that in the conventional type cable in which the ribbon cable is folded helically within its sheath, an exposed length of 130 mm is necessary, while in the cable of the invention, a exposed length of only 90 mm is necessary. In the cable according to the invention, since the side portions of the ribbon cable are arranged at opposite sides about the center thereof the ribbon cable is allowed to be expanded easily, thereby facilitating easy terminal treatment thereof. In addition, comparing the necessary exposed length of the ribbon cable of the invention with that of the other conventional cable, the exposed length of the ribbon cable be about ⅔ to ½ shorter while still facilitating easy connection to a line connector. Therefore, damage due to external forces is reduced and the cable of the invention can be used effectively for external wiring.

TABLE 3

| THE RESULTS (50 CONDUCTORS) | |
|---|---|
| CONVENTIONAL SPIRAL TYPE CABLE | 130 mm |
| CABLE OF THE INVENTION | 90 mm |

It will be appreciated that modifications may be made in the invention. For example, a ribbon cable which comprises a plurality of core wires the insulating portions of which are thermally welded to each other along their full length is applicable in a cable with a sheath according to the invention. Accordingly, it will to be understood that the invention is not limited to the specifically disclosed embodiments, and various changes and modifications may be effected therein by one skilled in the art without departing from the scope or the invention as defined in the appended claims.

What is claimed is:

1. A cable comprising:

a ribbon cable folded so as to define an S-shape cross section portion in the core of the cable, peripheral longitudinal side segments of said ribbon cable extending from the S-shaped cross section portion as a continuation thereof so as to surround the S-shaped cross section portion, said ribbon cable comprising a plurality of discrete conductors each of which is covered by an insulating member, said insulating members being bonded to each other; and a sheath covering said ribbon cable.

2. A cable as set forth in claim 1, including two of said longitudinal side segments, wherein said longitudinal side segments of said ribbon cable extend from the S-shaped cross section portion on opposite sides thereof.

3. A cable as set forth in claim 1, further comprising a shielding member protecting said conductors from electromagnetic interference.

4. A cable as set forth in claim 1, wherein said ribbon cable is provided with bonded and non-bonded sections which are alternately arrayed over the length of said rubber cable, said insulating members being mutually bonded so as to define a ribbon in said bonded sections and said insulating members being mutually separated in said non-bonded sections.

5. A cable comprising:

a ribbon cable folded so as to define an S-shape cross section portion in the core of the cable, peripheral longitudinal side segments of said ribbon cable extending from the S-shaped cross section portion as a continuation thereof so as to surround the S-shaped cross section portion, said ribbon cable comprising a plurality of discrete conductors each of which is covered by an insulating member, said ribbon cable being provided with bonded and non-bonded sections which are alternately arranged over the length of said ribbon cable, said insulating members being mutually bonded so as to define a ribbon in said bonded sections and said insulating members being mutually separated in said non-bonded sections, both side portions of said ribbon cable being arranged around said S-shaped cross section portion so as to be diametrically opposed about the center of the cable; and a sheath covering said ribbon cable.

6. A cable as set forth in claim 5, further comprising a shielding member preventing said circular cable from electromagnetic interference.

7. A sheath cable comprising: an outer sheath; and a ribbon cable comprising a plurality of discrete conductors each of which is covered by its own insulating member, said insulating members being bonded to each other so as to collectively define the width of said ribbon cable, said cable being folded within said sheath with respect to a center line wherein the center line halves the width of said ribbon cable and wherein a fold formed in one half of said width substantially matches a corresponding fold in the other half of said cable to form a generally S-shaped configuration and further including conductors provided with insulating members situated at each side of said width of said ribbon cable and extending in the same circumferential direction therefore, said ribbon cable and said conductors being provided within said outer sheath thereby forming a core within said sheath.

* * * * *

UNITED STATES PATENT AND TRADEMARK OFFICE

CERTIFICATE OF CORRECTION

PATENT NO. : 4,992,625

DATED : February 12, 1991

INVENTOR(S) : Isao Izui, Tetsuo Imamura, and Junichi Mori

It is certified that error appears in the above-identified patent and that said Letters Patent is hereby corrected as shown below:

In column 5, claim 4, line 42, change "arrayed" to --arranged--.

In column 5, claim 4, line 43, change "rubber" to --ribbon--.

Signed and Sealed this

Sixth Day of October, 1992

*Attest:*

DOUGLAS B. COMER

*Attesting Officer*

*Acting Commissioner of Patents and Trademarks*